United States Patent [19]

Goldschild et al.

[11] 4,256,282

[45] Mar. 17, 1981

[54] SUBSEA VALVE APPARATUS HAVING HYDRATE INHIBITING INJECTION

[75] Inventors: Pierre H. Goldschild, Vulaines sur Seine; Jean Franc, Paris, both of France

[73] Assignee: Schlumberger Technology Corporation, New York, N.Y.

[21] Appl. No.: 919,025

[22] Filed: Jun. 26, 1978

[30] Foreign Application Priority Data

Jun. 28, 1977 [FR] France ..... 77 19745

[51] Int. Cl.[3] ..... F16K 31/12; E21B 43/12

[52] U.S. Cl. ..... 251/58; 137/614.11; 166/244 C; 166/310; 166/321

[58] Field of Search ..... 137/614.11, 246, 246.22, 137/240; 166/244 C, 351, 321, 316, 324, 310; 251/58

[56] References Cited

U.S. PATENT DOCUMENTS

| | | | |
|---|---|---|---|
| 2,293,442 | 8/1942 | Montgomery | 166/310 |
| 2,654,436 | 10/1953 | Carlisle et al. | 166/310 |
| 2,852,080 | 9/1958 | Roach | 166/310 |
| 2,990,851 | 7/1961 | Jackson, Jr. et al. | 137/595 |
| 3,083,729 | 4/1963 | Poorman et al. | 137/625.69 |
| 3,199,595 | 8/1965 | Lafitte et al. | 166/364 |
| 3,536,344 | 10/1970 | Nelson | 166/319 |
| 3,592,263 | 7/1971 | Nelson | 166/244 C |
| 3,675,720 | 7/1972 | Sizer | 166/322 |
| 3,770,055 | 11/1973 | Larsen | 166/244 C |
| 3,901,313 | 8/1975 | Doniguiar et al. | 166/244 C |
| 3,967,647 | 7/1976 | Young | 137/614.11 |
| 4,011,906 | 3/1977 | Alexander et al. | 166/321 |
| 4,031,955 | 6/1977 | Ledet | 166/244 C |
| 4,042,033 | 8/1977 | Holland et al. | 166/321 |
| 4,057,108 | 10/1977 | Broussard | 166/244 C |

*Primary Examiner*—Martin P. Schwadron
*Assistant Examiner*—A. Michael Chambers
*Attorney, Agent, or Firm*—David L. Moseley; William R. Sherman

[57] ABSTRACT

In accordance with an illustrative embodiment of the present invention, a valve placed in a subsea blowout preventer stack during a production test of a well producing gas comprises a valve body containing two valve elements in series and a releasable control unit. A fluid to inhibit the formation of natural-gas hydrates can be injected into the valve body by means of a pump on the surface and through a high-pressure hose. A lateral connector fixed to the control unit is fitted in a sealed manner into a receptacle on the valve body to allow reconnection of the inhibiting fluid injection system.

7 Claims, 5 Drawing Figures

SUBSEA VALVE APPARATUS HAVING HYDRATE INHIBITING INJECTION

This invention relates generally to subsea valves used in wells and more particularly to valves placed in a subsea blowout preventer stack generally for carrying out production tests in offshore wells.

To conduct production tests in offshore wells, a technique developed in recent years includes installation in the blowout preventer stack of a subsea valve controlled from the surface. Such a valve, described for example in U.S. Pat. No. 3,967,647 granted to D. E. Young, comprises a valve body containing two valve elements in series. A housing member containing valve-element actuating cylinders is latched onto the valve body and can be disconnected from the surface by means of a hydraulic control.

If, during a test, the produced fluids contain gas, there is a risk of natural-gas hydrate formation in the flow through the valve. In fact, the blowout preventers in which the valve is placed constitute a good heat exchanger with seawater of which the temperature is about a few degrees C. Seawater thus cools the produced gases and there is the possibility of the formation of solid natural-gas hydrates which prevent proper functioning of the valve elements or which even block them. In certain gas fields in production, the formation of hydrates has already been prevented by injecting into the wellheads at the ground surface a small proportion of alcohol or glycol.

It is the object of the present invention to provide a new and improved valve of the type described which is equipped with a device allowing the injection of hydrate inhibiting fluid into the flow through the valve.

This and other objects are attained in accordance with the invention through the provision of an undersea valve for controlling the flow of fluids from an offshore well, including a valve body adapted to be fixed to a string of pipe extending into the well and providing a flow passage; valve element means mounted movably in the valve body to open and close the passage; a housing member adapted to be fixed to a conduit extending up to the surface; actuating means arranged in the housing member and controlled from the surface to move the valve element means; and latching means controlled from the surface for connecting and disconnecting the housing member to and from the valve body. The valve also comprises first fluid conducting means for bringing a hydrate inhibiting fluid from the surface up to the housing member under pressure; second fluid conducting means for bringing the inhibiting fluid through the valve body into the flow passage; and connection means comprising two parts fixed respectively to the housing member and to the valve body and communicating respectively with the first and second fluid conducting means to connect between them in a releasable manner the first and second fluid conducting means when the housing member is connected to the valve body. The second fluid conducting means contain at least one check valve which prevents the flow of fluid from the inside toward the outside of the valve body when the housing member is disconnected.

The present invention has other objects and features which will become more clearly apparent in connection with the following description, taken in conjunction with the appended drawings in which.

Figure 1:
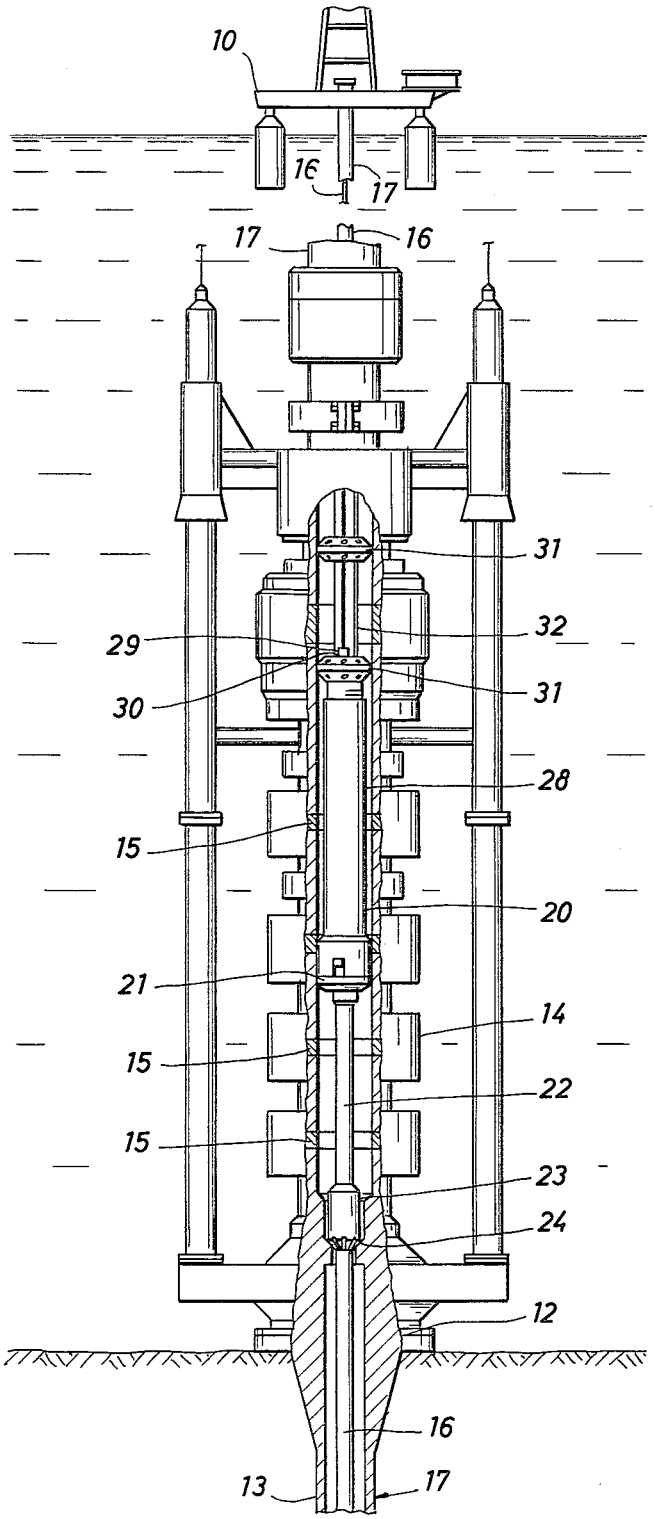
FIG. 1 is the diagram of an offshore drilling installation including an undersea valve according to the invention.

Referring initially to FIG. 1, a floating or semi-submersible offshore drilling platform is shown over an offshore well 11. On a casing head 12 fixed to the top of a well casing 13 is mounted a blowout preventer stack 14 comprising seals 15 which are movable laterally so as to shut off the annulus between the casing 13 and a production tubing 16. A riser 17 is connected to the top end of the blowout preventer stack and extends up to the surface where it is secured to the platform by a constant-tension device (not shown). Various hydraulic control lines connect the blowout preventer stack to the surface.

Inside the blowout preventer stack 14 is placed a valve connected into the pipe string 16 leading from the surface to the well formation being tested. The valve 20 includes a valve body 21 typically connected to a joint 22 having a fluted hanger 23 which bears on a shoulder 24. A hydraulic control unit 28 is removably connected to the upper end of the valve body 21. Hydraulic pressure transmitted through a line 29 which extends up to the surface makes it possible to open the valve elements located inside the body. The control unit 28 can be disconnected from the valve body in response to a hydraulic pressure transmitted by another line 30. Guide flanges 31 serve to center the valve 20 in the blowout preventer stack. A flexible tube 32 which extends up to the surface makes it possible to send into the valve from a pump placed on the platform 10 a hydrate formation inhibiting liquid.

Figure 2A:
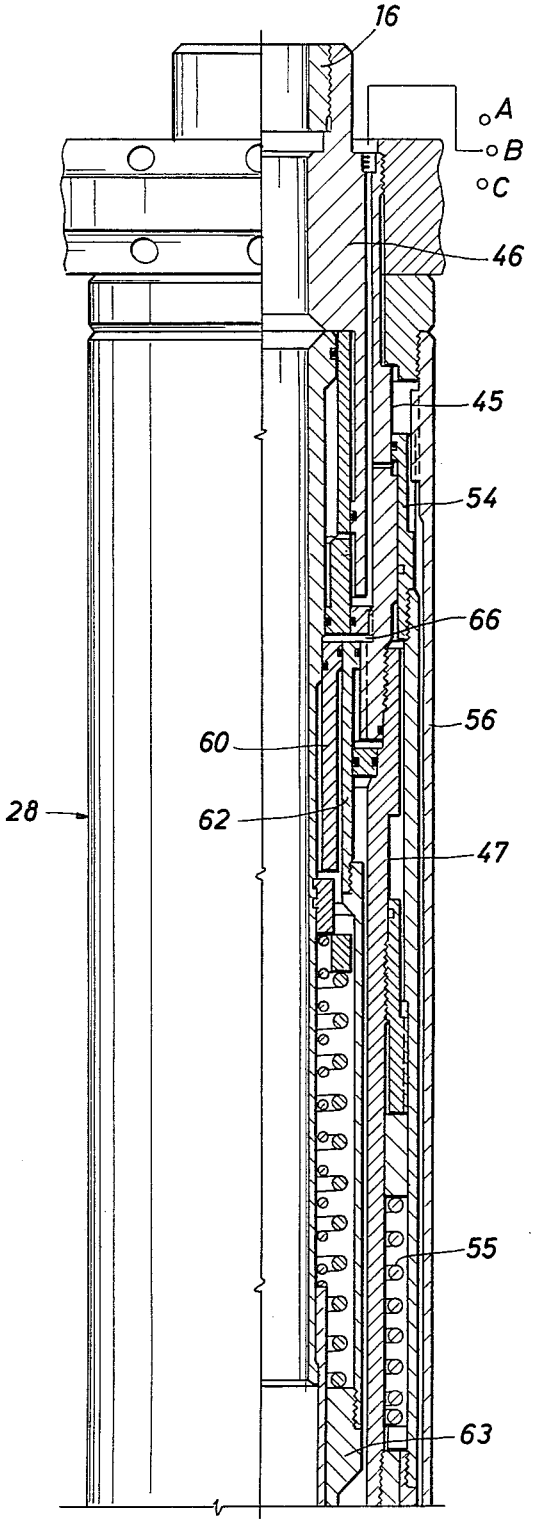
FIGS. 2A and 2B are longitudinal sections of a valve according to the invention.
Figure 2B:
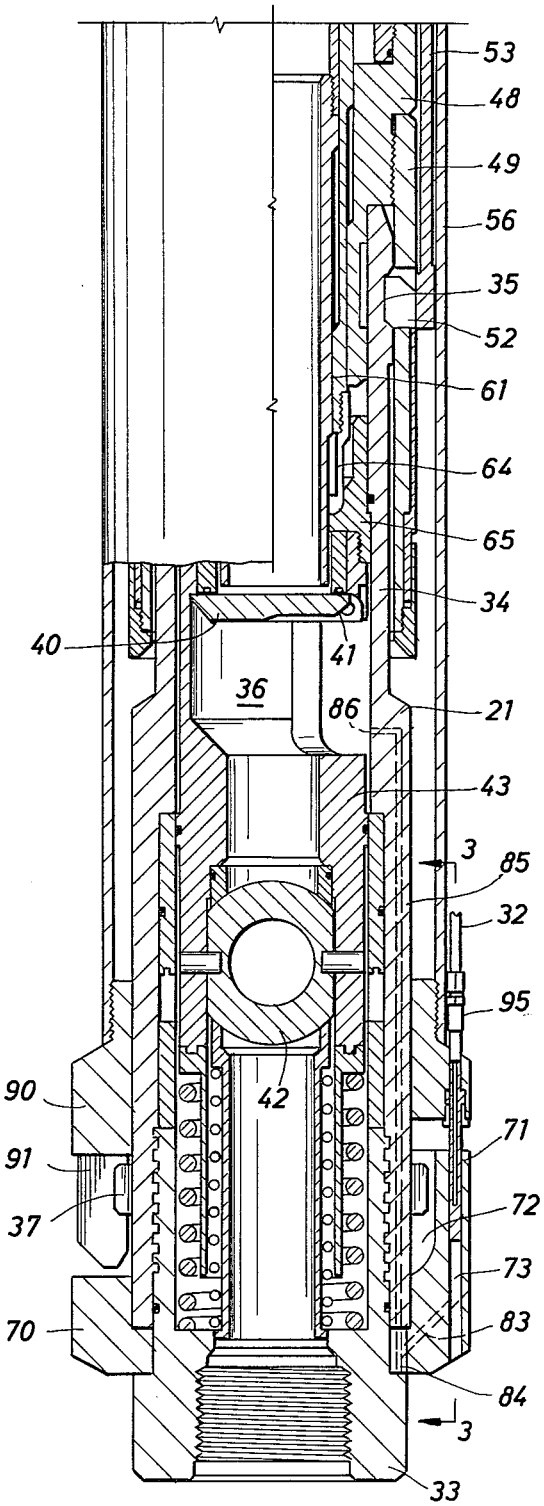

The valve 20 shown in greater detail in FIGS. 2A and 2B is of the type described in U.S. Pat. No. 3,967,647 granted to D. E. Young, but with the added improvement of a system for injecting a liquid inhibiting the formation of hydrates. For more details regarding the structure and operating method of such a valve, reference can be made to the above mentioned U.S. patent. We shall confine ourselves here to reviewing the main aspects.

The control valve 21 comprises a lower part 33 screwed to an upper part 34 provided with external lugs 37 and of which the top has a peripheral groove 35. The valve body is traversed by a longitudinal passage 36 capable of being closed by an upper valve assembly and a lower valve assembly. The upper valve assembly comprises a flapper valve element 40 loaded in the closing position by a spring 41. The lower valve assembly is made up of a ball valve element 42 mounted rotatably in a cage 43 loaded upward by a coil spring 44. If the cage 43 is moved downward in relation to the valve body, the ball valve element rotates to a position opening the flow passage.

The control unit 28 includes a housing member 45 in several parts 46, 47, 48 and 49 screwed at its upper end to the pipe string 16 and connected to the valve body by latch dogs 52 maintained in the groove 35 by a latch mandrel 53. A piston 54 supplied by the line B is fixed to the latch mandrel and is loaded downward by a spring 55. A protector sleeve 56 covers the assembly and fits over a large part of the valve body 21. The control unit contains means for actuating the valve assemblies. A first piston 60 drives via a lost-motion coupling an actuator sleeve 61 designed to open the flapper valve element 40. To open the ball valve element 42, a second piston 62 is fixed by a tube 63 with spring fingers 64 which engage in a ring 65 fixed to the cage 43 of this ball valve element. The two pistons 60 and 62 move downward when hydraulic fluid is sent under pressure through the line A into a chamber 66.

The operation of such a valve is straight forward. From the position shown in FIGS. 2A and 2B it is possible to open the two valve assemblies by sending hydraulic fluid under pressure into the chamber 66 through the line A. Then, the two pistons 60 and 62 move downward and drive, firstly, the spring fingers 64 which open the ball valve element 42 and, secondly, the actuator sleeve 61 which opens the flapper valve element 40. A release of applied pressure enables the springs 44 and 41 to cause the valve to close as the spring 68 repositions the actuator tube 61. It is possible to disconnect the control unit from the valve body by sending hydraulic fluid under pressure via line B. This causes the piston 54 to move upward and drive the latch mandrel 53 which frees the latch dogs. It is then possible to bring the drive unit up to the surface, leaving only the valve body in the subsea unit with the two valve assemblies closed.

In addition to the known elements described up to now, the valve apparatus of the present invention includes first fluid conducting means to bring a hydrate formation inhibiting liquid from the surface to the housing member. This liquid is, for example, glycol or methyl alcohol pumped from the surface through the flexible tube 32 consisting, for example, of a high-pressure hose (breaking pressure: 2,800 kg/cm$^2$). The valve also includes second fluid conducting means for bringing the inhibiting fluid through the valve body into the flow passage 36, and connection means between the first and second fluid conducting means.

Figure 3:
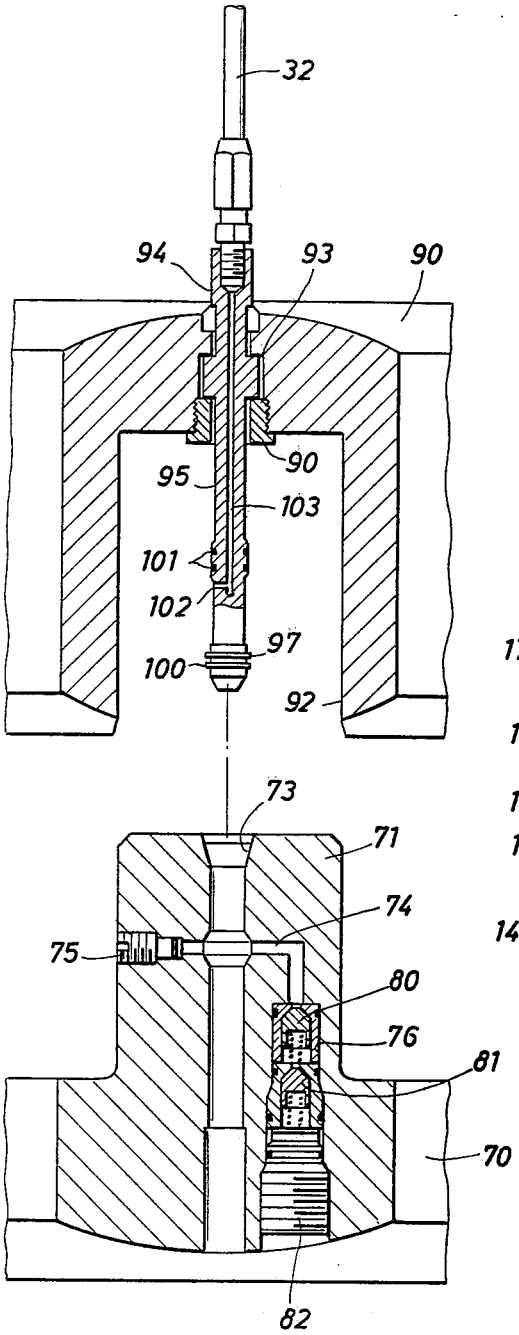
FIG. 3 is a longitudinal section along line 3—3 of FIG. 2B.

Between the parts 33 and 34 of the valve body is mounted a sleeve 70 (see also FIG. 3) which includes an upward extension 71. On the inside of the extension 71 is cut a longitudinal groove 72 adapted to engage on a lug 37 of the valve body. In the vertical axis of this extension is cut a bore 73 having a central part with a smaller diameter which is intersected by a horizontal passage 74 closed at its outer end by a plug 75. The passage 74 extends downward to a vertical recess 76 containing in series two check valves 80 and 81. The outlet of the check valves is closed toward the outside by a plug 82 but communicates with an inclined passage 83 (FIG. 2B) connected via a sealing sleeve 84 with a passage 85 cut in the part 34 of the valve body. The passage 85 leads into the axial flow passage 36 of the valve via an opening 86 located between the two valve elements. Alternatively, the opening 86 can be provided below the ball valve element 42.

At the lower part of the protector sleeve 56 is screwed a ring 90 which has three slots 91 opening downward and adapted to interfit with the three lugs 37 on the valve body. The ring 90 also has a fourth slot 92 of greater width (FIG. 3) which fits on the extension 71. Opposite the bore 73 of the extension 71, a recess 93 is cut in the ring 90 to receive an enlarged part 94 of a tubular connector 95. A bush 96 screwed into the ring 90 around the connector 95 keeps the latter in place while allowing a certain play so that its lower part 97 can be moved laterally with a small clearance. This lower part is equipped with lower and upper O-rings 100 and 101. Between the upper rings 101 and the lower rings 100 there is a portion with a smaller diameter in which there is an opening 102 which communicates with an axial passage 103 which extends upward from the connector 95. The flexible tube 32 is fixed to the upper part of the connector 95 so as to extend the passage 103 upward. The connector 95 is made so as to penetrate into the bore 73 until the lower and upper O-rings 100 and 101 are positioned respectively below and above the passage 74 when the control unit latches on the valve body. In this way is achieved a sealed continuous communication between the injection pump on the surface and the flow passage of the valve. A hydrate formation inhibiting fluid can thus be injected into the valve between the two valve elements. The surface pump is adapted to deliver a pressure capable of reaching 700 kg/cm$^2$.

In operation, if, during a test, the produced fluids contain gas, it may be feared, at the level of the undersea valve 20, natural-gas hydrates may form and would be liable to block the operation of the valve elements. Either as a preventive measure, or when hydrates begin to form, it is possible to inject glycol between the two valve elements from the surface. If, in an emergency, the control unit 28 is disconnected from the valve body 21, the valve body remains in the blowout preventer stack with the two valve assemblies closed. The check valves 80 and 81 prevent any flow of fluid from the space between the valve elements toward the outside of the valve body through the passage 85.

To reconnect the control unit 28 to the valve body, the control unit is lowered until the bottom of the ring 90 bears on the top of the extension 71 of the sleeve 70. The pipe string is then made to turn until the slot 92 is opposite the extension 71 and covers it, the connector 95 engaging in the bore 73. The injection of glycol can then be resumed if necessary in the flow passage.

Figure 4:
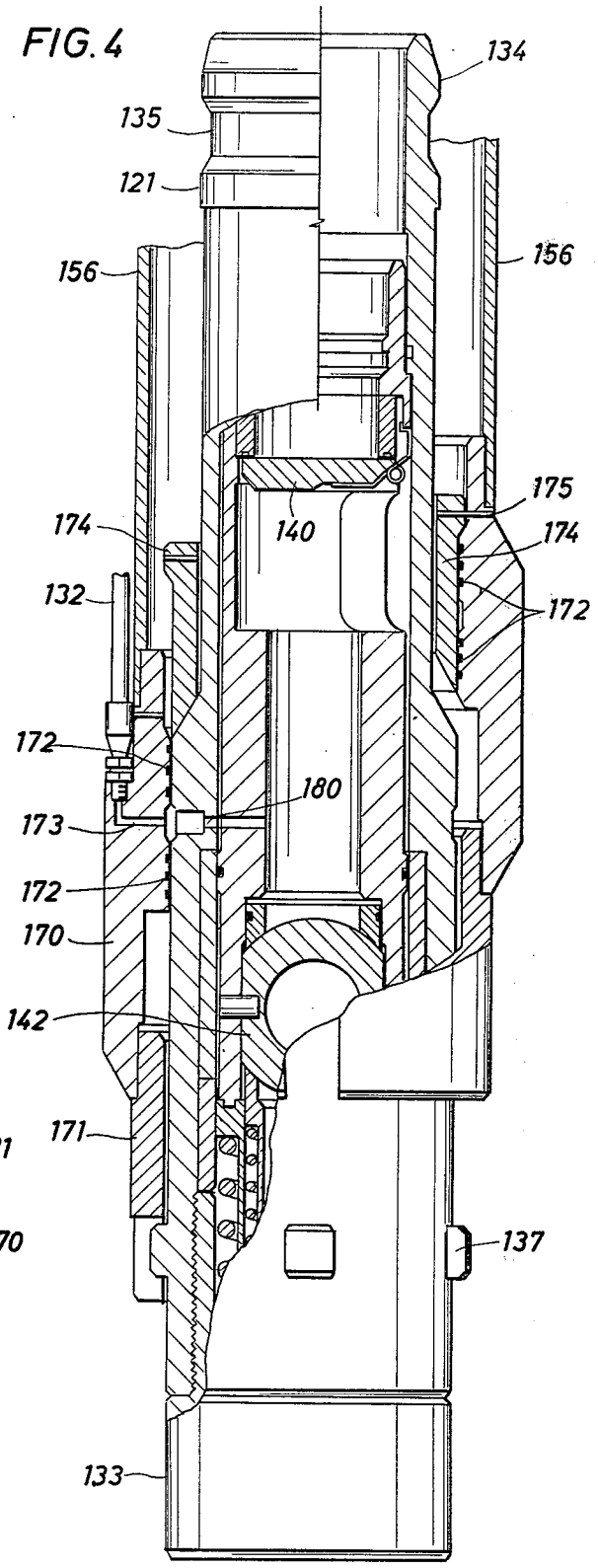
FIG. 4 is a longitudinal section of another embodiment of a valve according to the invention.

Referring to FIG. 4, another embodiment of the invention is shown in which the means of connecting the glycol line have a different form. Instead of the lateral connector of FIG. 2B, the connection between the first and second fluid conducting means is done by contact surfaces on the periphery of the valve body. As previously, a valve body 121 having a lower part 133 and an upper part 134 contains a valve element 140 of the flapper type and a ball valve element 142. On the valve body is connected a control unit having a protector sleeve 156. At the bottom of the sleeve 156 is screwed a ring 170 at the bottom of which is fixed a collar 171 having slots which engage on lugs 137 of the valve body. The ring 170 is equipped on its inside with O-rings 172 between which is located a passage 173 having an upward outlet on which is fixed the bottom of a flexible tube 132. The flexible tube 132 extends up to the surface where it is connected to the outlet of a glycol injection pump.

Before the ring 170 is entirely fitted on the valve body 121 (right-hand part of FIG. 4), the O-rings 172 are covered by a protective bush 174 kept in place by a shear pin 175. When this bush comes up against the inclined surface of the valve body, the pin 175 is sheared and then the O-rings 172 bear in a sealed manner against two contact surfaces provided on the periphery of the valve body 121. Between the contact surfaces and at the level of the passage 173, when the sleeve is in the low position (left-hand part of FIG. 4), a passage 180 goes through the valve body to allow the injection of glycol between the valve elements. This passage 180 preferably contains two check valves which prevent any flow from the inside toward the outside of the valve body when the ring 170 is disconnected. In this embodiment, the valve body 121 is slightly longer than in the apparatus of FIG. 2 to allow sufficient room for the protective bush 174.

As in the embodiment of FIG. 2, the control unit can be disconnected from the valve body in case of emergency. After reconnection of the control unit on the valve body, glycol or methyl alcohol injection can be begun again to prevent the formation of hydrates during the production tests.

The apparatus just described can of course allow many variants without departing from the scope of the invention. In particular, as already indicated, passages can be made in the valve body so as to bring the outlet of inhibiting fluid into the flow passage at a location below the two valve elements. In the example of FIG. 2B, it is also possible to fit a male connector on the valve body and a female connector on the control unit. The bore 73 will then be cut in the ring 90 and the sleeve 70 will carry the connector 95.

Since various changes or modifications may be made in the disclosed embodiment by those skilled in the art without departing from the inventive concepts involved, it is the aim of the appended claims to cover all such changes and modifications falling within the true spirit and scope of the present invention.

We claim:

1. In a subsea valve apparatus for use in controlling flow of fluids from an offshore well and including a valve body defining a flow passage, valve means in said body for opening and closing said passage, and a control unit releasably connected to said valve body for actuating said valve means, the improvement comprising;

first and second conduit means on said control unit and said valve body respectively for supplying a hydrate formation inhibiting fluid under pressure to said flow passage, said second conduit means including port means extending through the wall of said valve body and communicating with said flow passage at a location below said valve means, slidably engageable connector means on said control unit and said valve body for automatically connecting said first and second conduit means as said control unit is releasably connected to said valve body; and closing means in said second conduit means for preventing flow of fluids from said flow passage to the exterior of said valve body via said port means when said control unit is disconnected from said valve body.

2. The valve apparatus of claim 1 wherein said connector means comprises recess means offset laterally in a first member fixed to one of said valve body and said control unit, and a second member fixed to the other of said valve body and said control unit and adapted to slidably engage in a sealed manner in said recess means when said control unit is connected to said valve body.

3. The valve apparatus of claim 2 further including orienting means operable by rotating said control unit relative to said valve body for substantially aligning said second member with said recess means before said control unit is connected to said valve body.

4. The valve apparatus of claim 3 further including means for mounting one of said members to one of said valve body and said control unit with a certain play to facilitate the engagement of said second tubular member in said recess.

5. The valve apparatus of claim 1 wherein said connector means comprises an annular member mounted on said control unit and having upper and lower internal seal surfaces arranged to engage corresponding external seal surfaces on said valve body, said first and second conduit means including port means opening intermediate said seal surfaces, and a peripheral groove in one of said annular members and said valve body for establishing communication between said port means.

6. The valve apparatus of claim 5 further including movable means for protecting said seal surfaces on said annular member prior to connection of said control unit and said valve body.

7. The valve apparatus of claim 1 wherein said closing means comprises one-way check valve means.

* * * * *